US008188677B2

(12) United States Patent
Melanson et al.

(10) Patent No.: US 8,188,677 B2
(45) Date of Patent: May 29, 2012

(54) MULTI-FUNCTION DUTY CYCLE MODIFIER

(75) Inventors: John L. Melanson, Austin, TX (US); John J. Paulos, Austin, TX (US)

(73) Assignee: Cirrus Logic, Inc., Austin, TX (US)

( * ) Notice: Subject to any disclaimer, the term of this patent is extended or adjusted under 35 U.S.C. 154(b) by 0 days.

(21) Appl. No.: 13/206,212

(22) Filed: Aug. 9, 2011

(65) Prior Publication Data

US 2011/0291587 A1 Dec. 1, 2011

Related U.S. Application Data

(62) Division of application No. 12/047,258, filed on Mar. 12, 2008, now Pat. No. 8,018,171.

(60) Provisional application No. 60/894,295, filed on Mar. 12, 2007, provisional application No. 60/909,457, filed on Apr. 1, 2007.

(51) Int. Cl.
*H05B 37/00* (2006.01)

(52) U.S. Cl. ..... 315/291; 315/194; 315/DIG. 4

(58) Field of Classification Search ..... 315/194, 315/195, 199, 246, 250, 291, 295, DIG. 4
See application file for complete search history.

(56) References Cited

U.S. PATENT DOCUMENTS

| | | | | |
|---|---|---|---|---|
| 6,380,692 | B1 * | 4/2002 | Newman et al. | 315/194 |
| 6,998,792 | B2 * | 2/2006 | Takahashi et al. | 315/248 |
| 2007/0024213 | A1 * | 2/2007 | Shteynberg et al. | 315/291 |

* cited by examiner

*Primary Examiner* — David Hung Vu
(74) *Attorney, Agent, or Firm* — Hamilton & Terrile, LLP; Kent B. Chambers

(57) ABSTRACT

A system and method modify phase delays of a periodic, phase modulated mains voltage to generate at least two independent items of information during each cycle of the periodic input signal. The independent items of information can be generated by, for example, independently modifying leading edge and trailing edge phase delays of each half cycle phase modulated mains voltage. Modifying phase delays for the leading and trailing edges of each half cycle of the phase modulated mains voltage can generate up to four independent items of data. The items of data can be converted into independent control signals to, for example, control drive currents to respective output devices such as light sources to provide multiple items of information per cycle.

6 Claims, 13 Drawing Sheets

MULTI-FUNCTION DUTY CYCLE MODIFIER

CROSS-REFERENCE TO RELATED APPLICATIONS

This application is a divisional application of application Ser. No. 12/047,258, filed Mar. 12, 2008 now U.S. Pat. No. 8,018,171, which is incorporated herein by reference in its entirety.

This application claims the benefit under 35 U.S.C. §119 (e) and 37 C.F.R. §1.78 of U.S. Provisional Application No. 60/894,295, filed Mar. 12, 2007 and entitled "Lighting Fixture". U.S. Provisional Application No. 60/894,295 includes exemplary systems and methods and is incorporated by reference in its entirety.

This application claims the benefit under 35 U.S.C. §119 (e) and 37 C.F.R. §1.78 of U.S. Provisional Application No. 60/909,457, entitled "Multi-Function Duty Cycle Modifier," inventors John L. Melanson and John Paulos, and filed on Apr. 1, 2007 describes exemplary methods and systems and is incorporated by reference in its entirety. Referred to herein as Melanson I.

U.S. patent application Ser. No. 12/047,249, entitled "Ballast for Light Emitting Diode Light Sources," inventor John L. Melanson, and filed on Mar. 12, 2008 describes exemplary methods and systems and is incorporated by reference in its entirety. Referred to herein as Melanson II.

U.S. patent application Ser. No. 11/926,864, entitled "Color Variations in a Dimmable Lighting Device with Stable Color Temperature Light Sources," inventor John L. Melanson, and filed on Mar. 31, 2007 describes exemplary methods and systems and is incorporated by reference in its entirety.

This application also claims the benefit under 35 U.S.C. §119(e) of U.S. Provisional Application entitled "Multi-Function Duty Cycle Modifier", inventors John L. Melanson and John Paulos, and filed on Mar. 31, 2007 describes exemplary methods and systems and is incorporated by reference in its entirety.

U.S. patent application Ser. No. 11/695,024, entitled "Lighting System with Lighting Dimmer Output Mapping," inventors John L. Melanson and John Paulos, and filed on Mar. 31, 2007 describes exemplary methods and systems and is incorporated by reference in its entirety. Referred to herein as Melanson III.

U.S. patent application Ser. No. 11/864,366, entitled "Time-Based Control of a System having Integration Response," inventor John L. Melanson, and filed on Sep. 28, 2007 describes exemplary methods and systems and is incorporated by reference in its entirety. Referred to herein as Melanson IV.

U.S. patent application Ser. No. 11/967,269, entitled "Power Control System Using a Nonlinear Delta-Sigma Modulator with Nonlinear Power Conversion Process Modeling," inventor John L. Melanson, and filed on Dec. 31, 2007 describes exemplary methods and systems and is incorporated by reference in its entirety. Referred to herein as Melanson V.

U.S. patent application Ser. No. 11/967,275, entitled "Programmable Power Control System," inventor John L. Melanson, and filed on Dec. 31, 2007 describes exemplary methods and systems and is incorporated by reference in its entirety. Referred to herein as Melanson VI.

U.S. patent application Ser. No. 12/047,262, entitled "Power Control System for Voltage Regulated Light Sources," inventor John L. Melanson, and filed on Mar. 12, 2008 describes exemplary methods and systems and is incorporated by reference in its entirety. Referred to herein as Melanson VII.

U.S. patent application Ser. No. 12/047,269, entitled "Lighting System with Power Factor Correction Control Data Determined from a Phase Modulated Signal," inventor John L. Melanson, and filed on Mar. 12, 2008 describes exemplary methods and systems and is incorporated by reference in its entirety.

BACKGROUND OF THE INVENTION

1. Field of the Invention

The present invention relates in general to the field of electronics, and more specifically to a system and method for utilizing and generating a phase modulated output signal having multiple, independently generated phase delays per cycle of the phase modulated output signal.

2. Description of the Related Art

Commercially practical incandescent light bulbs have been available for over 100 years. However, other light sources show promise as commercially viable alternatives to the incandescent light bulb. LEDs are becoming particularly attractive as main stream light sources in part because of energy savings through high efficiency light output and environmental incentives such as the reduction of mercury.

LEDs are semiconductor devices and are driven by direct current. The lumen output intensity (i.e. brightness) of the LED approximately varies in direct proportion to the current flowing through the LED. Thus, increasing current supplied to an LED increases the intensity of the LED and decreasing current supplied to the LED dims the LED. Current can be modified by either directly reducing the direct current level to the white LEDs or by reducing the average current through duty cycle modulation.

Dimming a light source saves energy when operating a light source and also allows a user to adjust the intensity of the light source to a desired level. Many facilities, such as homes and buildings, include light source dimming circuits (referred to herein as "dimmers").

FIG. 1 depicts a lighting circuit 100 with a conventional dimmer 102 for dimming incandescent light source 104 in response to inputs to variable resistor 106. The dimmer 102, light source 104, and voltage source 108 are connected in series. Voltage source 108 supplies alternating current at mains voltage $V_{mains}$. The mains voltage $V_{mains}$ can vary depending upon geographic location. The mains voltage $V_{mains}$ is typically 120 $V_{AC}$ (Alternating Current) with a typical frequency of 60 Hz or 230 $V_{AC}$ with a typical frequency of 50 Hz. Instead of diverting energy from the light source 104 into a resistor, dimmer 102 switches the light source 104 off and on many times every second to reduce the total amount of energy provided to light source 104. A user can select the resistance of variable resistor 106 and, thus, adjust the charge time of capacitor 110. A second, fixed resistor 112 provides a minimum resistance when the variable resistor 106 is set to 0 ohms. When capacitor 110 charges to a voltage greater than a trigger voltage of diac 114, the diac 114 conducts and the gate of triac 116 charges. The resulting voltage at the gate of triac 116 and across bias resistor 118 causes the triac 116 to conduct. When the current I passes through zero, the triac 116 becomes nonconductive, i.e. turns 'off'. When the triac 116 is nonconductive, the dimmer output voltage $V_{DIM}$ is 0 V. When triac 116 conducts, the dimmer output voltage $V_{DIM}$ equals the mains voltage $V_{mains}$. The charge time of capacitor 110 required to charge capacitor 110 to a voltage sufficient to trigger diac 114 depends upon the value of current I. The value of current I depends upon the resistance of variable resistor 106 and resistor 112. Thus, adjusting the resistance of variable resistor 106 adjusts the phase angle of dimmer output voltage $V_{DIM}$. Adjusting the phase angle of dimmer output voltage $V_{DIM}$ is equivalent to adjusting the phase angle of dimmer output voltage $V_{DIM}$. Adjusting the phase angle of dimmer output voltage $V_{DIM}$ adjusts the average power to light source 104, which adjusts the intensity of light source 104. The term "phase angle" is also commonly referred to as a "phase delay". Thus, adjusting the phase angle of dimmer output voltage $V_{DIM}$ can also be referred to as adjusting the phase delay of dimmer output signal $V_{DIM}$. Dimmer 102 only modifies the leading edge of each half cycle of voltage $V_{mains}$.

FIG. 2 depicts the periodic dimmer output voltage $V_{DIM}$ waveform of dimmer 102. The dimmer output voltage fluctuates during each period from a positive voltage to a negative voltage. (The positive and negative voltages are characterized with respect to a reference to a direct current (dc) voltage level, such as a neutral or common voltage reference.) The period of each full cycle 202.0 through 202.N is the same as 1/frequency as voltage $V_{mains}$, where N is an integer. The dimmer 102 chops the voltage half cycles 204.0 through 204.N and 206.0 through 206.N to alter the duty cycle of each half cycle. The dimmer 102 chops the first half cycle 204.0 (e.g. positive half cycle) at time $t_1$ so that half cycle 204.0 is 0 V from time $t_0$ through time $t_1$ and has a positive voltage from time $t_1$ to time $t_2$. The light source 104 is, thus, turned 'off' from times $t_0$ through $t_1$ and turned 'on' from times $t_1$ through $t_2$. Dimmer 102 chops the first half cycle 206.0 with the same timing as the second half cycle 204.0 (e.g. negative half cycle). So, the duty cycles of each half cycle of cycle 202.0 are the same. Thus, the full duty cycle of dimmer 102 for cycle 202.0 is represented by Equation [1]:

$$\text{Duty Cycle} = \frac{(t_2 - t_1)}{(t_2 - t_0)}. \quad [1]$$

When the resistance of variable resistance 106 is increased, the duty cycle of dimmer 102 decreases. Between time $t_2$ and time $t_3$, the resistance of variable resistance 106 is increased, and, thus, dimmer 102 chops the full cycle 202.N at later times in the first half cycle 204.N and the second half cycle 206.N of the full cycle 202.N with respect to cycle 202.0. Dimmer 102 continues to chop the first half cycle 204.N with the same timing as the second half cycle 206.N. So, the duty cycles of each half cycle of cycle 202.N are the same. Thus, the full duty cycle of dimmer 102 for cycle 202.N is:

$$\text{Duty Cycle} = \frac{(t_5 - t_4)}{(t_5 - t_3)}. \quad [2]$$

Since times $(t_5-t_4)<(t_2-t_1)$, less average power is delivered to light source 104 by the sine wave 202.N of dimmer voltage $V_{DIM}$ and the intensity of light source 104 decreases at time $t_3$ relative to the intensity at time $t_2$.

The voltage and current fluctuations of conventional dimmer circuits, such as dimmer 102, can destroy LEDs. U.S. Pat. No. 7,102,902, filed Feb. 17, 2005, inventors Emery Brown and Lodhie Pervaiz, and entitled "Dimmer Circuit for LED" (referred to here as the "Brown Patent") describes a circuit that supplies a specialized load to a conventional AC dimmer which, in turn, controls a LED device. The Brown Patent describes dimming the LED by adjusting the duty cycle of the voltage and current provided to the load and providing a minimum load to the dimmer to allow dimmer current to go to zero.

Exemplary modification of leading edges and trailing edges of dimmer signals is discussed in "Real-Time Illumination Stability Systems for Trailing-Edge (Reverse Phase Control) Dimmers" by Don Hausman, Lutron Electronics Co., Inc. of Coopersburg, Pa., U.S.A., Technical White Paper, December 2004 ("Hausman Article), and in U.S. Patent Application Publication, 2005/0275354, entitled "Apparatus and Methods for Regulating Delivery of Electrical Energy", filed Jun. 10, 2004, inventors Hausman, et al. ("Hausman Publication") Both the Hausman Article and Hausman Publication are incorporated herein by reference in their entireties.

Thus, conventional dimmers provide dependently generated phase delays per cycle of a phase modulated signal.

SUMMARY OF THE INVENTION

In one embodiment of the present invention, an apparatus to generate at least two independent signals in response to at least two independent items of information derived from at least two independently generated phase delays per cycle of a phase modulated mains voltage signal includes a phase delay detector to detect at least two independently generated phase delays per cycle of the phase modulated mains voltage signal and to generate respective data signals. Each data signal represents an item of information conforming to one of the phase delays. The apparatus further includes a controller, coupled to the phase delay detector, to receive the data signals and, for each received data signal, to generate a control signal in conformity with the item of information represented by the data signal.

In another embodiment of the present invention, a method to generate at least two independent signals in response to at least two independent items of information derived from at least two independently generated phase delays per cycle of a phase modulated mains voltage signal includes detecting at least two independent phase delays per cycle of the phase modulated mains voltage signal. Each phase delay represents an independent item of information. The method further includes generating respective data signals. Each data signal represents an item of information conforming to one of the phase delays; and for each data signal. The method also includes generating a control signal in conformity with the item of information represented by the data signal.

An apparatus includes a dimming control to receive at least two respective inputs representing respective dimming levels and a dimming signal generator, coupled to the dimming control, to generate a phase modulated output signal having at least two independently generated phase delays per cycle of the phase modulated mains voltage signal. Each dimming level is represented by one of the phase delays.

In another embodiment of the present invention, a method includes receiving at least two respective inputs representing respective dimming levels and independently generating at least two phase delays per cycle in a mains voltage signal to generate a phase modulated output signal. Each phase delay per cycle represents a respective dimming level.

BRIEF DESCRIPTION OF THE DRAWINGS

The present invention may be better understood, and its numerous objects, features and advantages made apparent to those skilled in the art by referencing the accompanying drawings. The use of the same reference number throughout the several figures designates a like or similar element.

DETAILED DESCRIPTION

A system and method modify phase delays of a periodic, phase modulated mains voltage to generate at least two independent items of information during each cycle of the periodic input signal. The independent items of information can be generated by, for example, independently modifying leading edge and trailing edge phase delays of each half cycle phase modulated mains voltage. Modifying phase delays for the leading and trailing edges of each half cycle of the phase modulated mains voltage can generate up to four independent items of data. The items of data can be converted into independent control signals to, for example, control drive currents to respective output devices such as light sources. In at least one embodiment, a dimmer generates the phase delays of the mains voltage to generate the phase modulated mains voltage. The phase delays can be converted into current drive signals to independently control the intensity of at least two different sets of lights, such as respective sets of light emitting diodes (LEDs).

Figure 1:
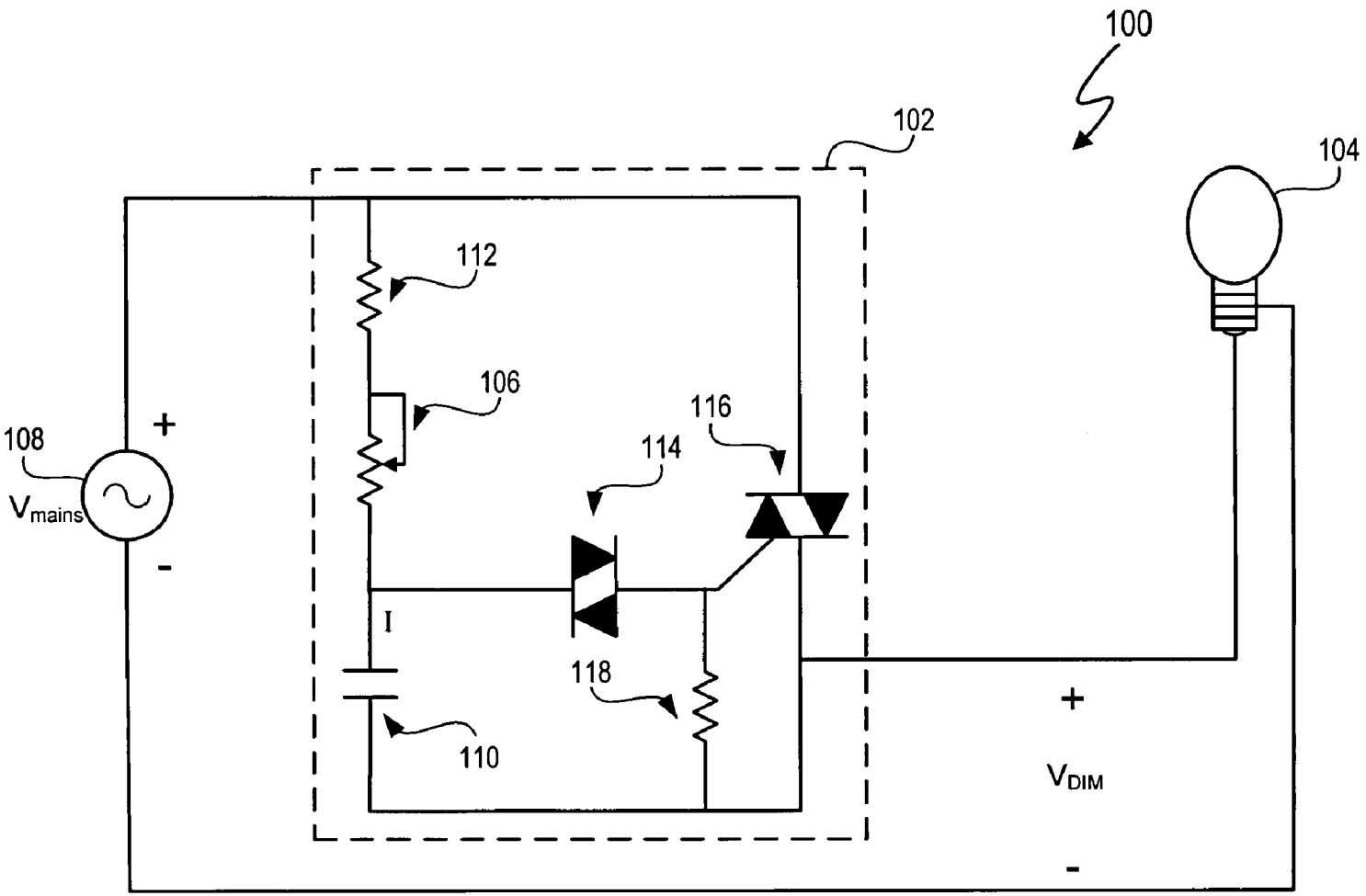
Figure 1 (prior art)
FIG. 1 (labeled prior art) depicts a lighting circuit with a conventional dimmer for dimming an incandescent light source.
Figure 2:
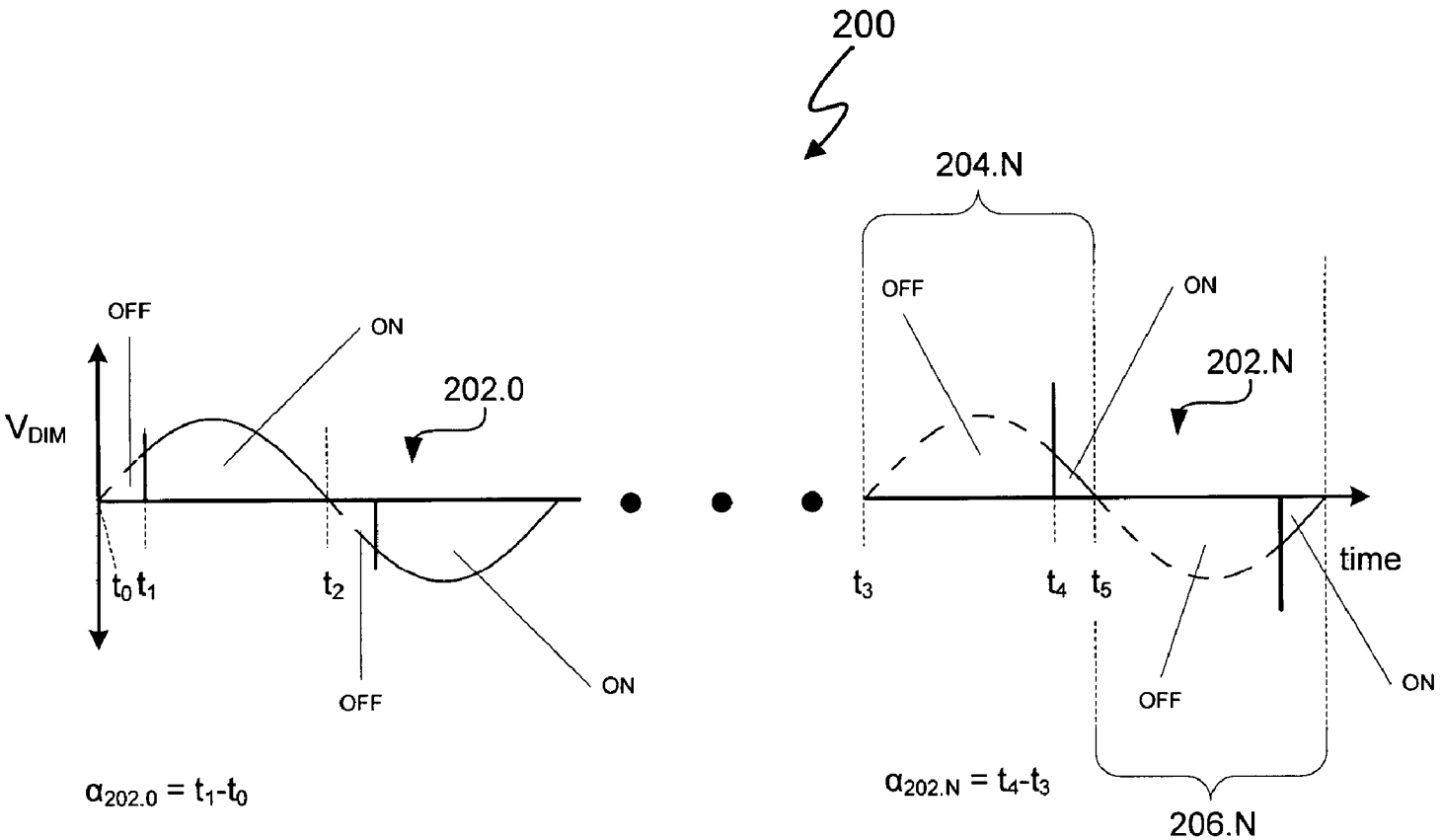
Figure 2 (prior art)
FIG. 2 (labeled prior art) depicts a dimmer circuit output voltage waveform.
Figure 3A:
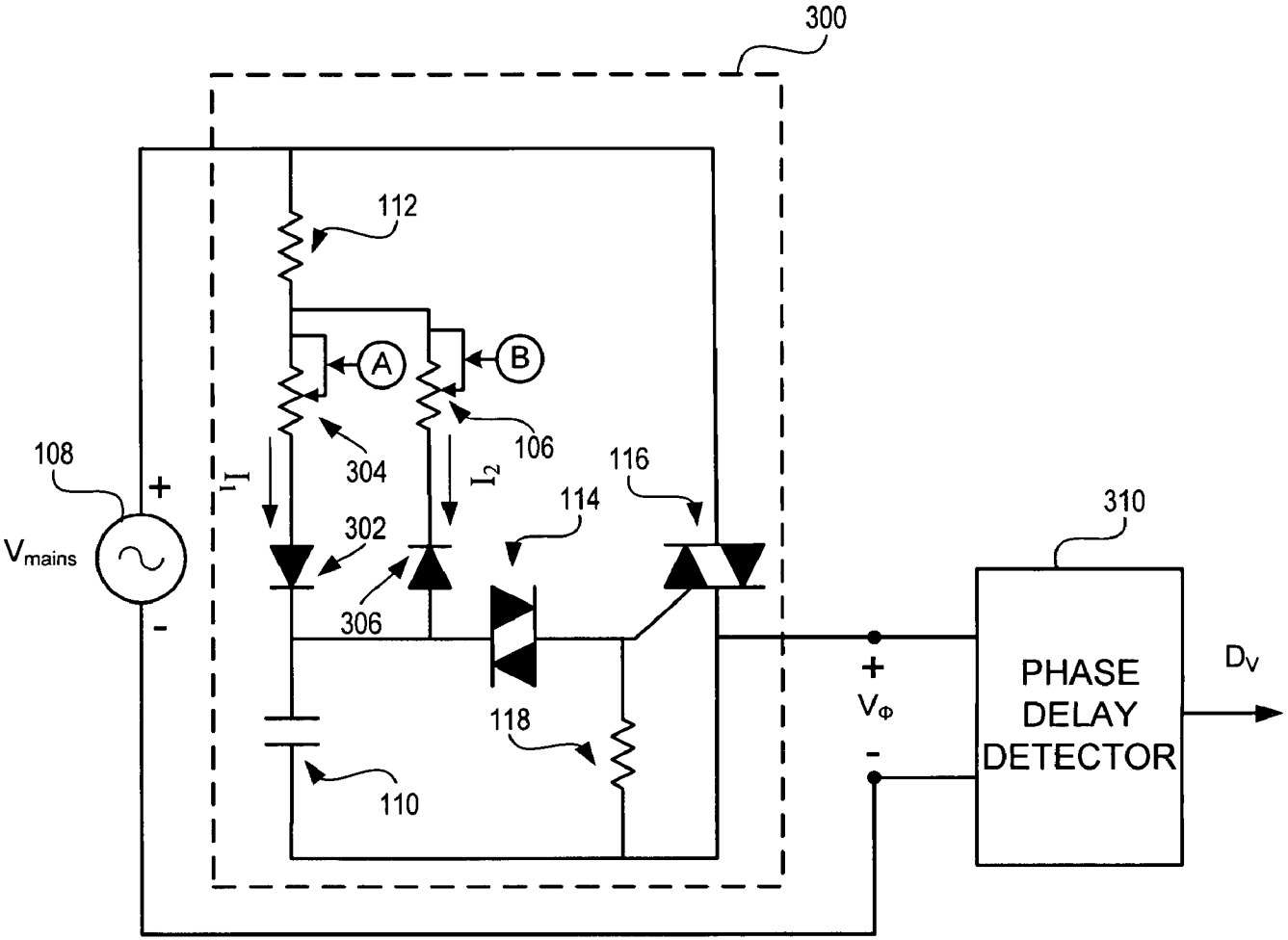
FIG. 3A depicts a duty cycle modifier.

FIG. 3A depicts a phase modulator 300 that chops the leading and/or trailing edges of the positive and/or negative half cycle of AC mains voltage $V_{mains}$ to generate a phase modulated output signal $V_{\Phi}$. The mains voltage $V_{mains}$ is generally supplied by a power station or other AC voltage source. The mains voltage $V_{mains}$ is typically 120 $V_{AC}$ with a typical frequency of 60 Hz or 230 $V_{AC}$ with a typical frequency of 50 Hz. Each cycle of mains voltage $V_{mains}$ has a first half cycle and a second half cycle. In at least one embodiment, the two half cycles are respectively referred to as a positive half cycle and a negative half cycle. "Positive" and "negative" reflect the relationship between the cycle halves and do not necessarily reflect positive and negative voltages.

The phase modulator 300 generates between 2 to 4 phase delays for each full cycle of the phase mains voltage $V_{\Phi}$. At least two of the phase delays per cycle are independently generated. An independently generated phase delay represents a separate item of information from any other phase delay in the same cycle. A dependently generated phase delay redundantly represents an item of information represented by another phase delay in the same cycle, either in the same half cycle or a different half cycle.

In at least one embodiment, phase delays are divided into four categories. Positive half cycle leading edge phase delays and trailing edge phase delays represent two of the categories, and negative half cycle leading edge and trailing edge phase delays represent two additional categories. The positive half cycle phase delays occur in the positive half cycle, and the negative half cycle phase delays occur in the negative half cycle. The leading edge phase delays represent the elapsed time between a beginning of a half cycle and a leading edge of the phase modulated mains voltage $V_{\Phi}$. The trailing edge phase delays represent the elapsed time between a trailing edge of the phase modulated mains voltage $V_{\Phi}$ and the end of a half cycle. Phase delays may be dependently or independently generated. The half cycles are separated by the zero crossings of the original, undimmed mains voltage $V_{mains}$.

Figure 4A:
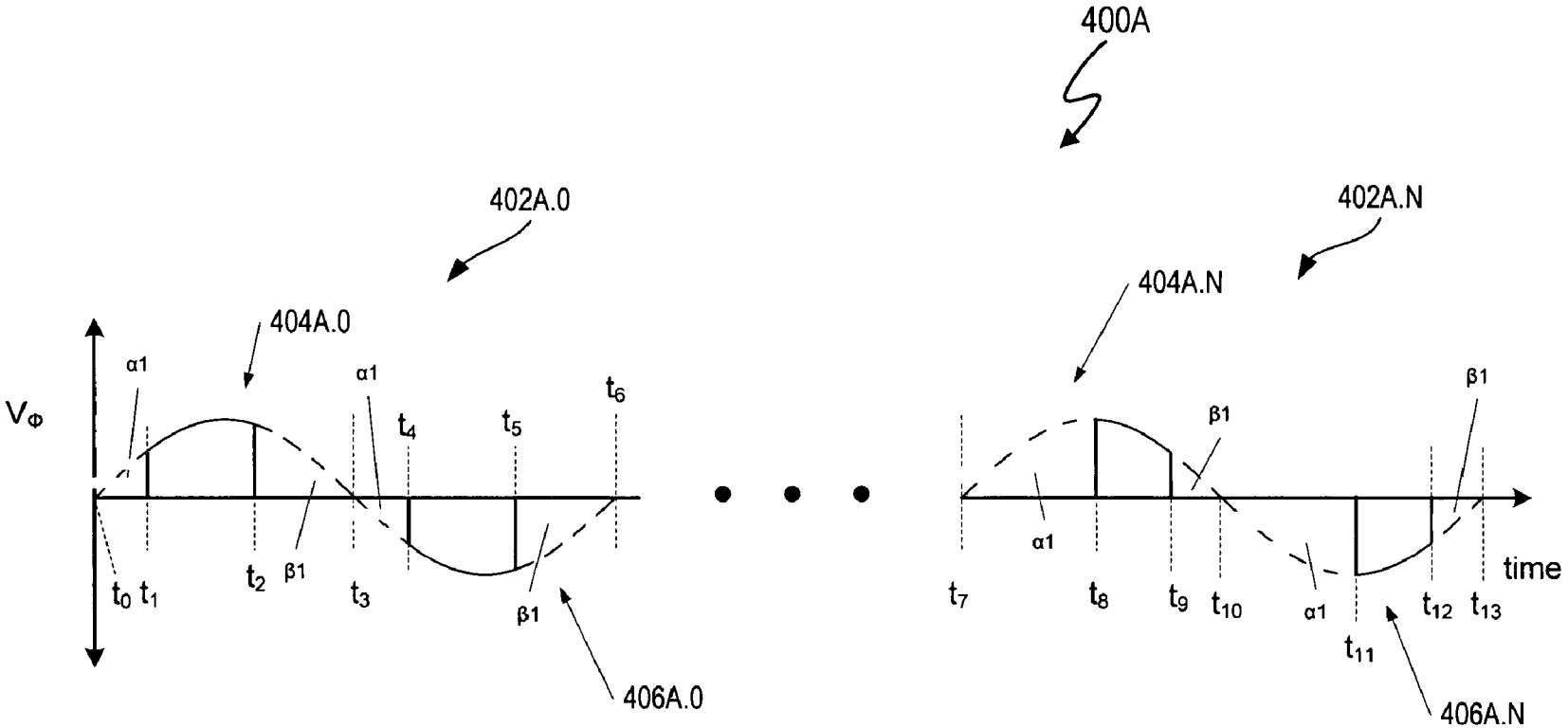
FIGS. 4A-4D depict a waveform with independently generated phased delays per cycle of a phase modulated signal.

Referring to FIGS. 3A and 4A, in at least one embodiment, the phase delay of the first half cycle of phase modulated output signal $V_{\Phi}$ is controlled by the value selectable current $I_1$. During each first half cycle of mains voltage $V_{mains}$, diode 302 conducts current $I_1$, and current $I_1$ charges capacitor 110. When capacitor 110 charges to a voltage greater than a trigger voltage of diac 114, the diac 114 conducts and the gate of triac 116 charges. The resulting voltage at the gate of triac 116 and across bias resistor 118 causes the triac 116 to conduct until current $I_1$ falls to zero at the end of the first half cycle of mains voltage $V_{mains}$. The elapsed time between the beginning of the half cycle and when the triac 116 begins to conduct represents a leading edge phase delay. When the triac 116 is nonconductive, the phase modulated output signal $V_{\Phi}$ is 0 V. When triac 116 conducts a leading edge is generated, and the output voltage $V_{OUT}$ equals the mains voltage $V_{mains}$. The conduction time of triac 116 during the first half cycle of mains voltage $V_{mains}$ is directly related to the charge time of capacitor 110 and is, thus, directly related to the value of current $I_1$. The conduction time of triac 116 during the first half cycle of mains voltage $V_{mains}$ directly controls a leading edge phase delay of the first half cycle of output voltage $V_{OUT}$. Thus, the value of current $I_1$ directly corresponds to the phase delay of the first half cycle of phase modulated output signal $V_{\Phi}$.

The resistor 112 and variable resistor 304 control the value of current $I_1$ during each first half cycle of mains voltage $V_{mains}$. Thus, the value of current $I_1$ is selectable by changing the resistance of variable resistor 304. Therefore, varying selectable current $I_1$ varies the leading edge phase delay of the first half cycle of phase modulated output signal $V_{\Phi}$.

The leading edge phase delay of the negative cycle of phase modulated output signal $V_{\Phi}$ is controlled by selectable current $I_2$. During each negative cycle of mains voltage $V_{mains}$, diode 306 conducts current $I_2$, and current $I_2$ charges capacitor 110. When capacitor 110 charges to a voltage greater than a trigger voltage of diac 114, the diac 114 conducts and the gate of triac 116 charges. The resulting voltage at the gate of triac 116 and across bias resistor 118 causes the triac 116 to conduct until current $I_2$ falls to zero at the end of the negative cycle of mains voltage $V_{mains}$. When triac 116 begins to conduct, a leading edge of the second half cycle of phase modulated output signal $V_{\Phi}$ is generated. The elapsed time between the beginning of the second half cycle and the leading edge of the second half cycle represents a leading edge phase delay of the second half cycle. The conduction time of triac 116 during the second half cycle of mains voltage $V_{mains}$ is directly related to the charge time of capacitor 110 and is, thus, directly related to the value of current $I_2$. The conduction time of triac 116 during the second half cycle of mains voltage $V_{mains}$ directly controls the leading edge phase delay of the second half cycle of phase modulated output signal $V_{\Phi}$. Thus, the value of current $I_2$ directly corresponds to the leading edge phase delay of the second half cycle of phase modulated output signal $V_{\Phi}$.

The resistance value of variable resistor 304 is set by input A. The resistance value of variable resistor 306 is set by input B. In at least one embodiment, variable resistor 304 is a potentiometer with a mechanical wiper. The resistance of variable resistor 304 changes with physical movement of the wiper. In at least one embodiment, variable resistor 304 is implemented using semiconductor devices to provide a selectable resistance. In this embodiment, the input A is a control signal received from a controller. The controller set input A in response to an input, such as a physical button depression sequence, a value received from a remote control device, and/or a value received from a timer or motion detector. The source or sources of input A can be manual or any device capable of modifying the resistance of variable resistor 304. In at least one embodiment, variable resistor 306 is the same as variable resistor 304. As with input A, the source of input B can be manual or any device capable of modifying the resistance of variable resistor 306. The output voltage $V_{OUT}$ is provided as an input to phase delay detector 310. Phase delay detector 310 detects the phase delays of phase modulated output signal $V_\Phi$ and generates a digital dimmer output signal value $D_{V_X}$ for each independently generated phase delay per cycle. X is an integer index value ranging from 0 to M, and M+1 represents the number of independently generated phase delays per cycle of phase modulated output signal $V_\Phi$. In at least one embodiment, M ranges from 1 to 3. Dimmer signals $D_{V_0}, \ldots, D_{V_M}$ are collectively represented by "$D_V$". The values of digital dimmer output signals $D_V$ can be used to generate control signals and drive currents.

Figure 3B:
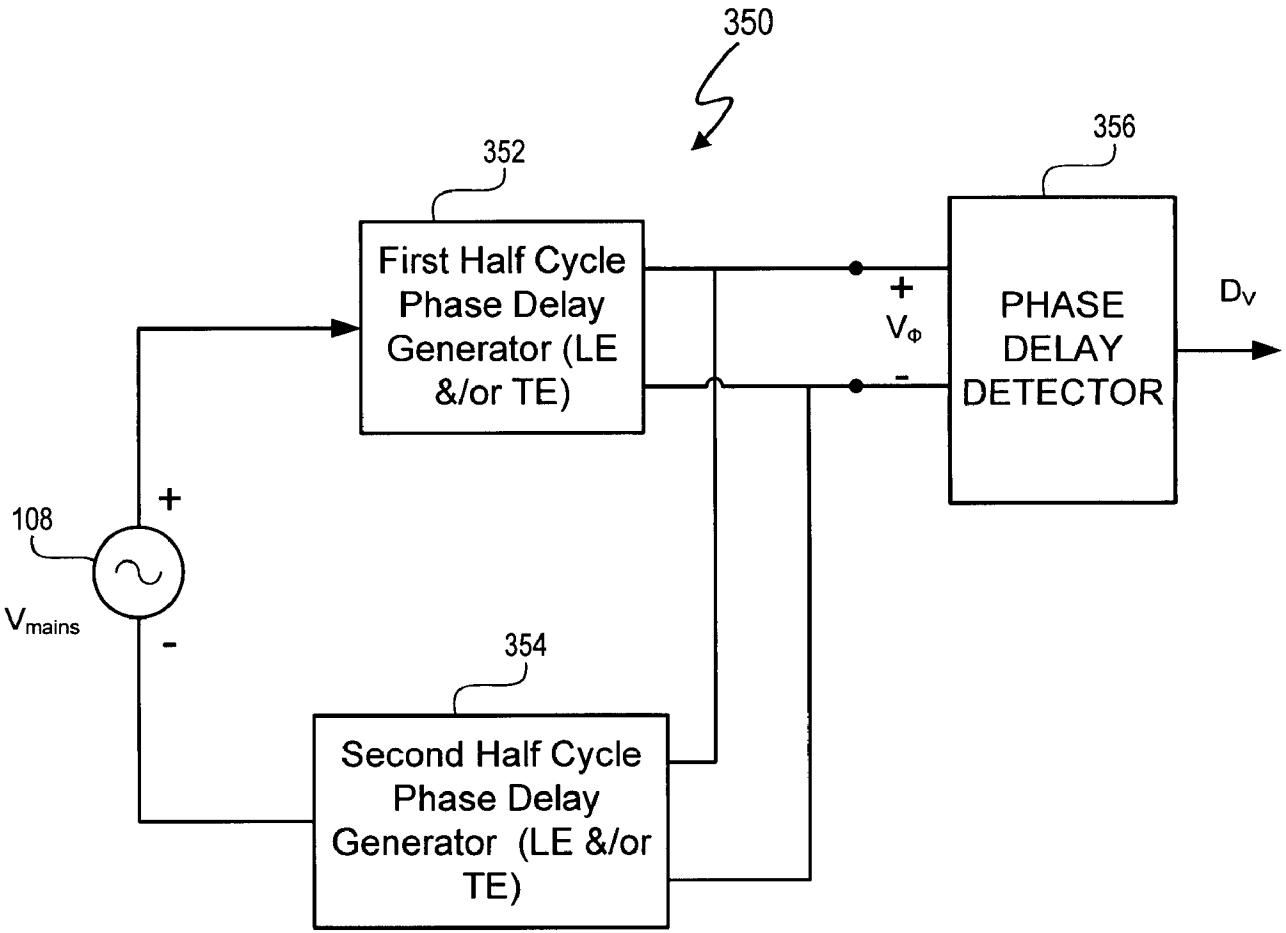
FIG. 3B depicts another duty cycle modifier.

FIG. 3B depicts a phase modulator 350 that independently or dependently modifies the leading edge (LE) and/or trailing edges (TE) of mains voltage $V_{mains}$ to generate 2 to 4 phase delays representing 2 to 4 items of information per cycle of phase modulated output signal $V_\Phi$ The number of independent phase delays generate by phase modulator 350 is a matter of design choice. The phase modulator 300 represents one embodiment of the phase modulator 350. The first half cycle phase delay generator 352 generates phase delays in the first half cycle of input signal $V_{mains}$ by chopping the mains voltage $V_{mains}$ to generate a leading edge, trailing edge, or both the leading and trailing edges of phase modulated output signal $V_\Phi$. The second half cycle phase delay generator 354 generates phase delays in the second half cycle of input signal $V_{mains}$ by chopping the mains voltage $V_{mains}$ to generate a leading edge, trailing edge, or both the leading and trailing edges of phase modulated output signal $V_\Phi$. Thus, depending upon the configuration of phase modulator 350, two to four independent items of data are generated per each cycle of the input signal $V_{mains}$.

The input mains voltage $V_{mains}$ can be chopped to generate both leading and trailing edges as for example described in U.S. Pat. No. 6,713,974, entitled "Lamp Transformer For Use With An Electronic Dimmer And Method For Use Thereof For Reducing Acoustic Noise", inventors Patchornik and Barak. U.S. Pat. No. 6,713,974 describes an exemplary system and method for leading and trailing edge voltage chopping and edge detection. U.S. Pat. No. 6,713,974 is incorporated herein by reference in its entirety.

FIGS. 4A, 4B, 4C, and 4D depict exemplary respective waveforms 400A, 400B, 400C, and 400D of phase modulated output signal $V_\Phi$. The waveforms 400A, 400B, 400C, and 400D represent cycles of a phase modulated mains voltage $V_\Phi$. The waveforms 400A, 400B, 400C, and 400D each include between 2 and 4 independently generated phase delays per cycle. Leading edge phase delays are represented by "α" (alpha), and trailing edge delays are represented by "β" (beta).

FIG. 4A depicts leading and trailing edge phase delays of two exemplary cycles 402A.0 and 402A.N of the waveform 400A of phase modulated output signal $V_\Phi$. Each cycle of leading edge phase delays α1 generated in the first and second half cycles 404A.0 and 406A.0, respectively, independently of the trailing edge phase delays β1 of the first and second half cycles 404A.0 and 406A.0. The second half cycle repeats the first half cycle, so the two leading edge phase delays are not independent, and the two trailing edge phase delays are also not independent.

As previously discussed, the leading edge phase delays represent the elapsed time between a beginning of a half cycle and a leading edge of the phase modulated mains voltage $V_\Phi$. The trailing edge phase delays represent the elapsed time between a trailing edge of the phase modulated mains voltage $V_\Phi$ and the end of a half cycle. An exemplary determination of the phase delays for waveform 400A is set forth below. The phase delays for waveforms 400B-400D are similarly determined and subsequently set forth in Table 2.

In the first half cycle 404A.0, leading edge phase delay is the elapsed time between the occurrence of the first half cycle 404A.0 leading edge at time $t_1$ and the beginning of the first half cycle 404A.0 at time $t_0$, i.e. the first half cycle 404A.0 leading edge phase delay $\alpha 1 = t_1 - t_0$. In the second half cycle 406A.0, leading edge phase delay $\alpha 1 = t_4 - t_3 = t_1 - t_0$.

In the first half cycle 404A.0, trailing edge phase delay is the elapsed time between the occurrence of the first half cycle 404A.0 trailing edge at time $t_2$ and the end of the first half cycle at time $t_3$, i.e. the first half cycle 404A.0 of trailing edge phase delay $\beta_1 = t_3 - t_2$. In the second half cycle 406A.0, leading edge phase delay $\beta_1 = t_6 - t_5 = t_3 - t_2$.

The phase modulator 350 generates new leading edge phase delays α1 and trailing edge phase delays β1 for cycle 402A.N. As with cycle 402A.N, the leading edges phase delays α1 of the first and second half cycles 404A.N and 406A.N are not generated independently of each other but are generated independently of trailing edge phase delays β1. Likewise, the trailing edges phase delays β1 of the first and second half cycles 404A.N and 406A.N are not generated independently of each other but are generated independently of leading edge phase delays α1. Accordingly, the phase delays of each cycle of waveform 400A represent two items of information.

In at least one embodiment, waveform 400A is generated with identical leading edge phase delays for the first and second half cycles of each cycle of phase modulated output signal $V_\Phi$ and identical trailing edge phase delays for the first and second half cycles of each cycle of phase modulated output signal $V_\Phi$ because the symmetry between the first half cycle 404A.X and the second half cycle 406A.X facilitates keeping dimmer output signals $D_V$ free of DC signals. In an application with a large current drain due to lighting equipment, in at least one embodiment, it is also desirable to protect a mains transformer (not shown) from excessive DC current. In at least one embodiment, waveforms such as waveform 400A, that have first half cycles with approximately the same area as second half cycles facilitate keeping dimmer output signals $D_V$ free of DC signals.

Figure 4B:
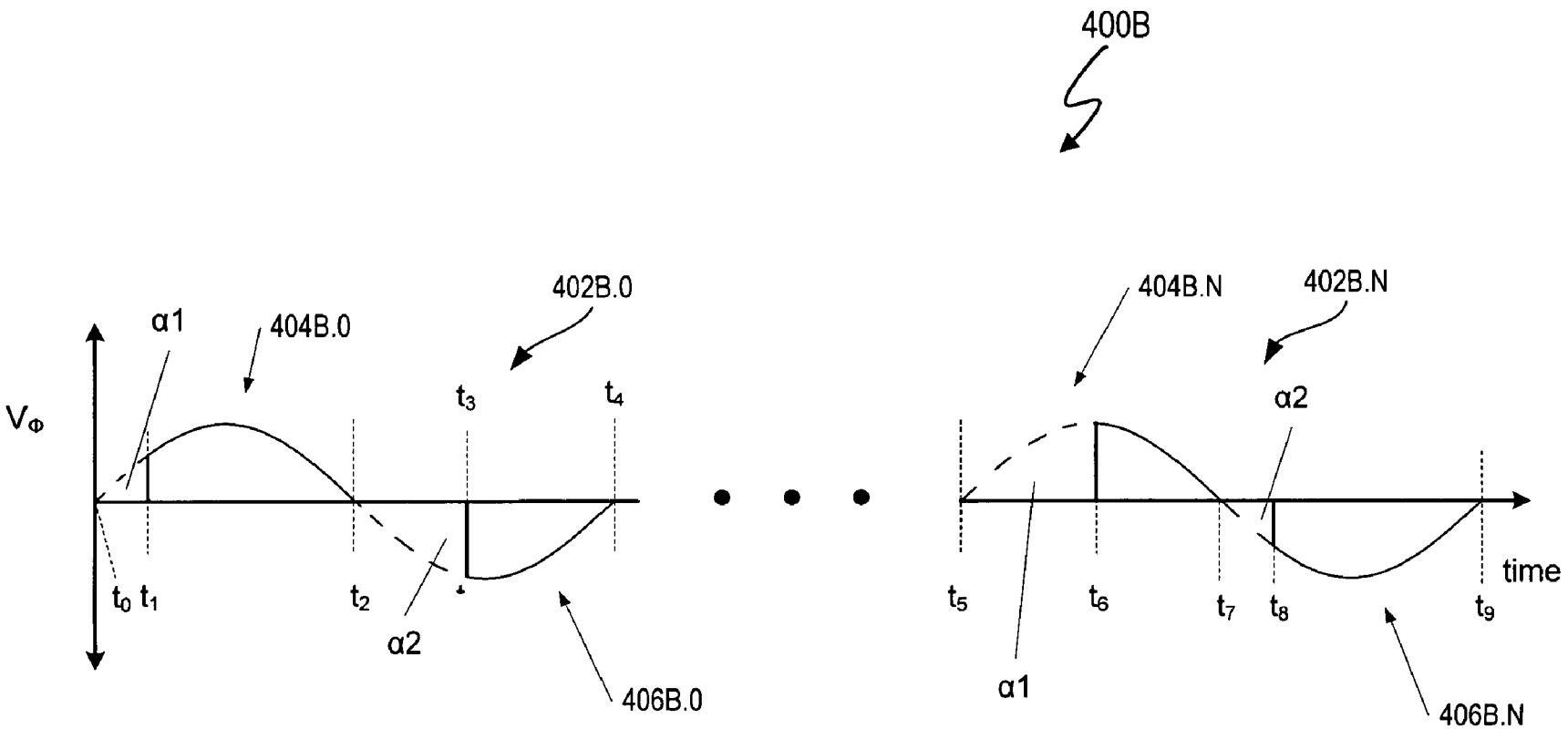

FIG. 4B depicts independently generated leading edge phase delays of two exemplary cycles 402B.0 and 402B.N of the waveform 400B of phase modulated output signal $V_\Phi$. Full cycle 402B.0 is composed of first half cycle 404B.0 and second half cycle 406B.0. Full cycle 402B.N is composed of first half cycle 404B.N and second half cycle 406B.N. Waveform 400B depicts the independent generation of a first half cycle leading edge phase delay α1 and a second half cycle leading edge phase delay α2.

Figure 4C:
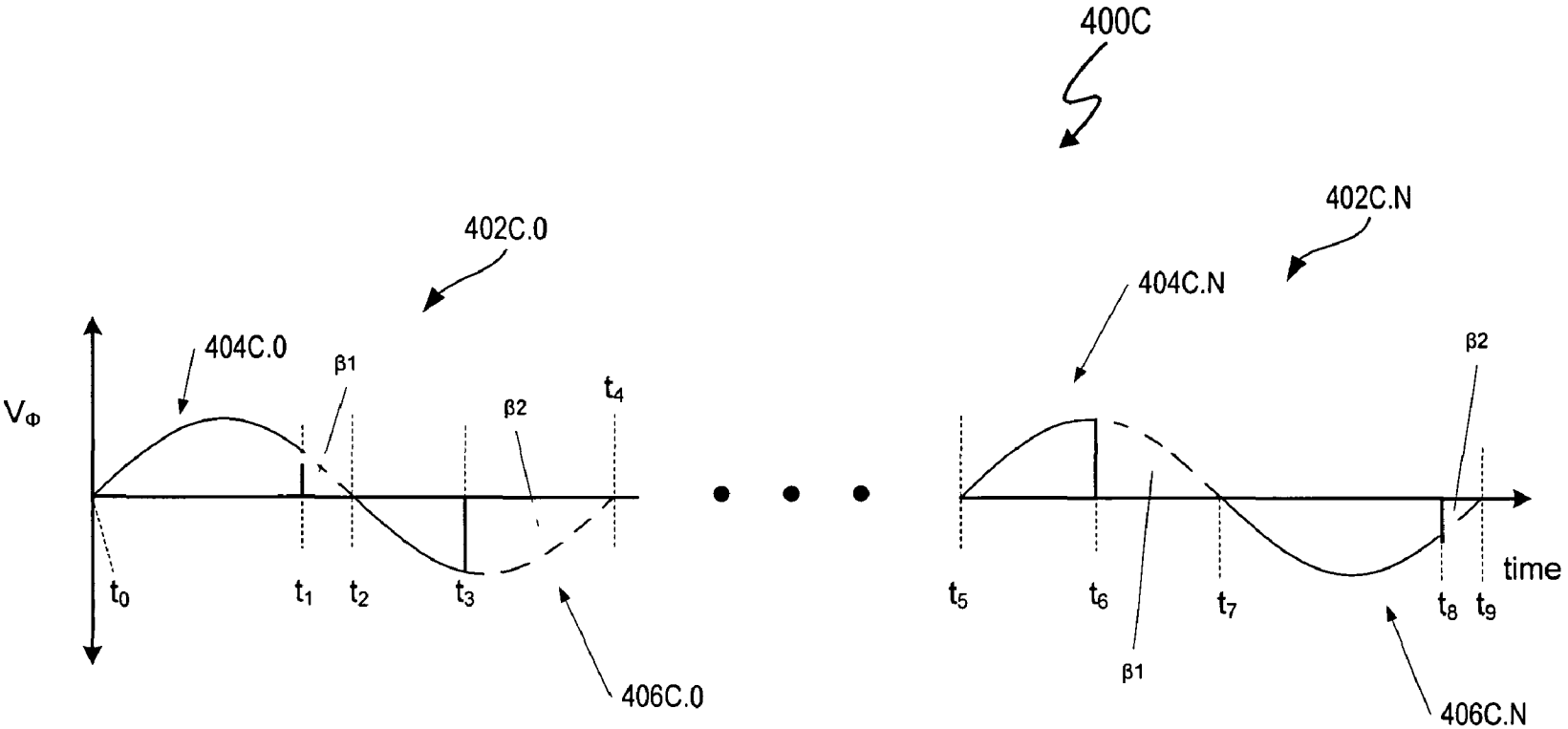

FIG. 4C depicts independently generated trailing edge phase delays of two exemplary cycles 402C.0 and 402C.N of the waveform 400C of phase modulated output signal $V_\Phi$. Full cycle 402C.0 is composed of first half cycle 404C.0 and second half cycle 406C.0. Full cycle 402C.N is composed of first half cycle 404C.N and second half cycle 406C.N. Waveform 400C depicts the independent generation of a first half cycle trailing edge phase delay $\beta 1$ and a second half cycle trailing edge phase delay $\beta 2$.

Figure 4D:
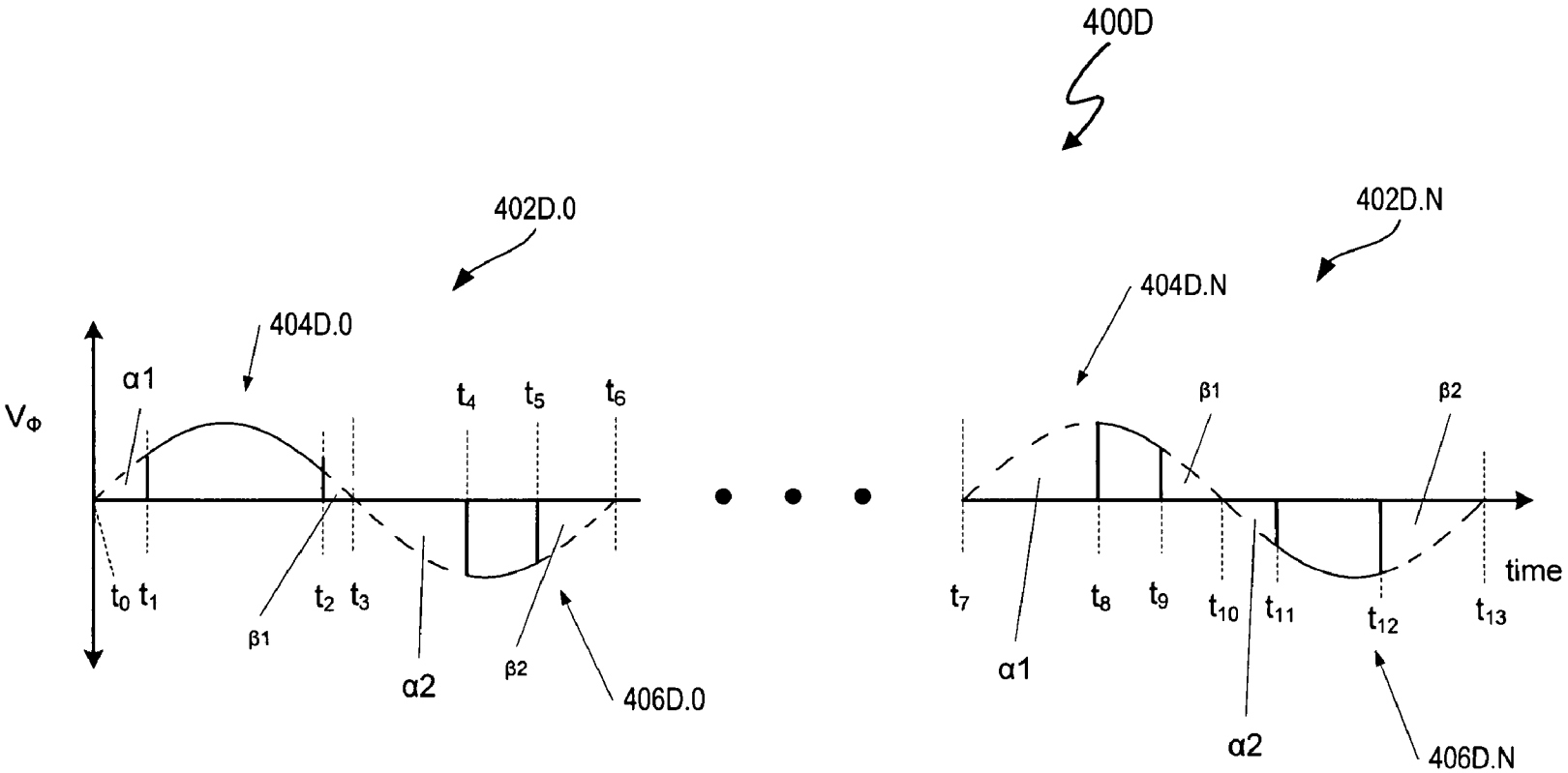

FIG. 4D depicts independently generated leading edges and trailing edges for both half cycles of two exemplary cycles 402D.0 and 402D.N of the waveform 400D of phase modulated output signal $V_\Phi$. Full cycle 402D.0 is composed of first half cycle 404D.0 and second half cycle 406D.0. Full cycle 402D.N is composed of first half cycle 404D.N and second half cycle 406D.N. Waveform 400D depicts the independent generation of a first half cycle leading edge phase delay $\alpha 1$, a first half cycle trailing edge phase delay $\beta 1$, a second half cycle leading edge phase delay $\alpha 2$, and a second half cycle trailing edge phase delay $\beta 2$.

Table 1 sets forth the phase delays and corresponding time values of waveforms 400A-400D:

TABLE 1

| Cycles & Half Cycles | Phase Delay |
|---|---|
| 402A.0 | $\alpha 1 = (t_1 - t_0) = (t_4 - t_3)$ |
| 402A.0 | $\beta 1 = (t_3 - t_2) = (t_6 - t_5)$ |
| 402A.N | $\alpha 1 = (t_8 - t_7) = (t_{11} - t_{10})$ |
| 402A.N | $\beta 1 = (t_{10} - t_9) = (t_{13} - t_{12})$ |
| 402B.0 | $\alpha 1 = (t_1 - t_0)$ |
| 402B.0 | $\alpha 2 = (t_3 - t_2)$ |
| 402B.N | $\alpha 1 = (t_6 - t_5)$ |
| 402B.N | $\alpha 2 = (t_8 - t_7)$ |
| 402C.0 | $\beta 1 = (t_2 - t_1)$ |
| 402C.0 | $\beta 2 = (t_4 - t_3)$ |
| 402C.N | $\beta 1 = (t_7 - t_6)$ |
| 402C.N | $\beta 2 = (t_9 - t_8)$ |
| 404D.0 | $\alpha 1 = (t_1 - t_0)$ |
| 404D.0 | $\beta 1 = (t_3 - t_2)$ |
| 406D.0 | $\alpha 2 = (t_4 - t_3)$ |
| 406D.0 | $\beta 2 = (t_6 - t_5)$ |
| 404D.N | $\alpha 1 = (t_7 - t_8)$ |
| 404D.N | $\beta 1 = (t_{10} - t_9)$ |
| 406D.N | $\alpha 2 = (t_{11} - t_{10})$ |
| 406D.N | $\beta 2 = (t_{13} - t_{12})$ |

The independent phase delays of the first half cycle and the second half cycle of each waveform of phase modulated output signal $V_\Phi$ represent independent items of information. The waveforms 400A, 400B, and 400C each have two independent items of information per cycle of phase modulated output signal $V_\Phi$. The waveform 400D has four independent items of information per cycle of phase modulated output signal $V_\Phi$.

Table 2 depicts the independent items of information available from the phase delays for each cycle of each depicted waveform of phase modulated output signal $V_\Phi$.

TABLE 2

| Waveform | Information |
|---|---|
| 400A | $\alpha 1, \beta 1$ |
| 400B | $\alpha 1, \alpha 2$ |
| 400C | $\beta 1, \beta 2$ |
| 400D | $\alpha 1, \beta 1, \alpha 2, \beta 2$ |

Figure 4E:
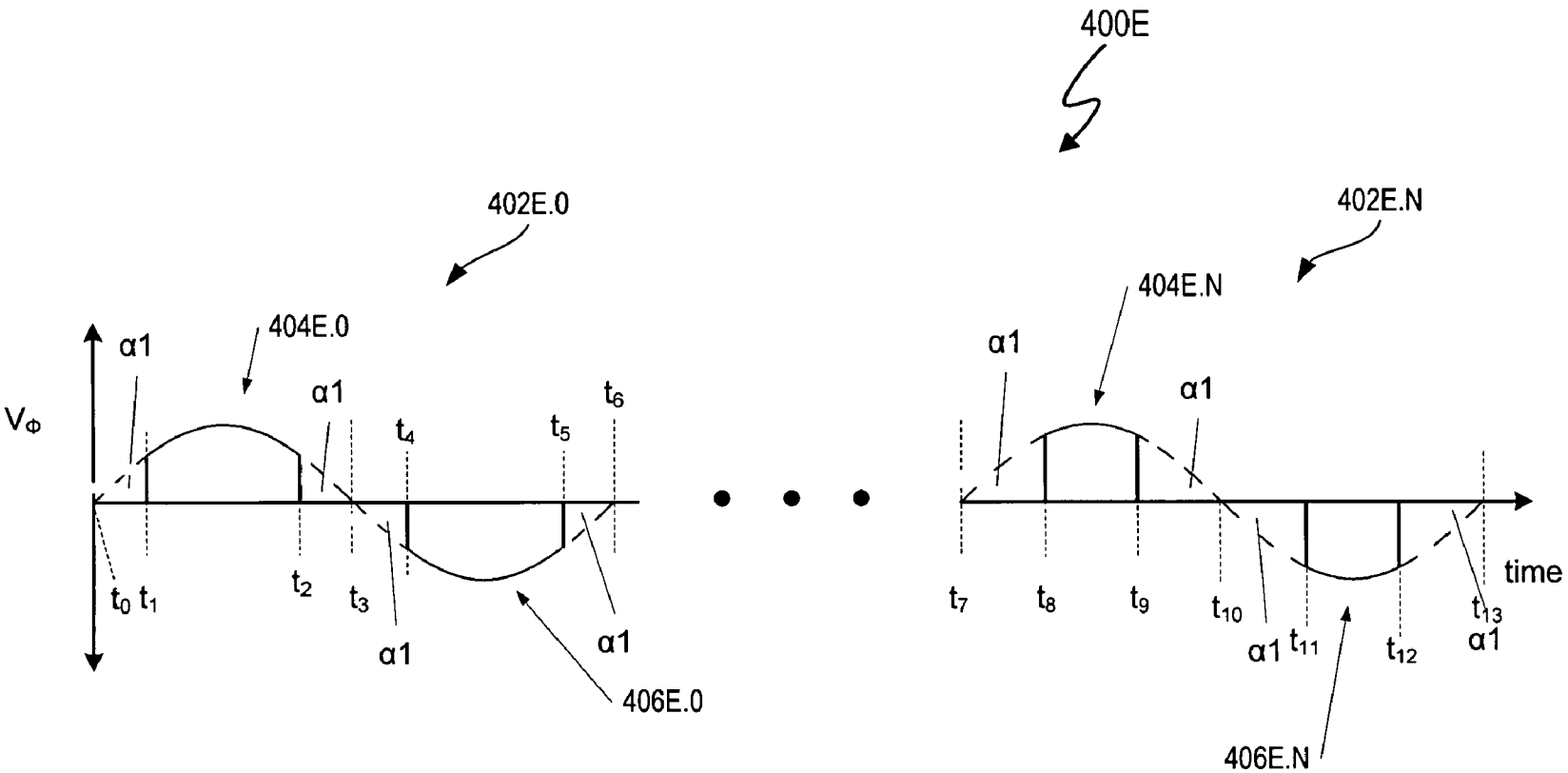
FIG. 4E depicts a phase modulated signal with symmetric leading and trailing edges.

FIG. 4E depicts a waveform 400E representing an exemplary phase modulated output signal $V_\Phi$ with four dependent phase delays per cycle but only one item of information per cycle. The two depicted cycles 402E.0 and 402E.N each have respective half cycles 404E.0 & 406E.0 and 404E.N & 406E.N. The leading and trailing edges of each half cycle have a phase delay of $\alpha 1$. Although, the waveform 400E only includes one independent phase delay $\alpha 1$, the symmetry of the leading and trailing edges of each cycle of waveform 400E make detection of the phase delay $\alpha 1$ relatively easy compared to detection of leading edge only or trailing edge only phase delays. Additionally, the symmetry of waveform 400E facilitates keeping dimmer output signal $D_V$ free of DC signals.

The individual items of information from each cycle can be detected, converted into data, such as digital data, and used to generate respective control signals. The control signals can, for example, be converted into separate current drive signals for light sources in a lighting device and/or used to implement predetermined functions, such as actuating predetermined dimming levels in response to a particular dimming level or in response to a period of inactivity of a dimmer, etc.

Figure 3C:
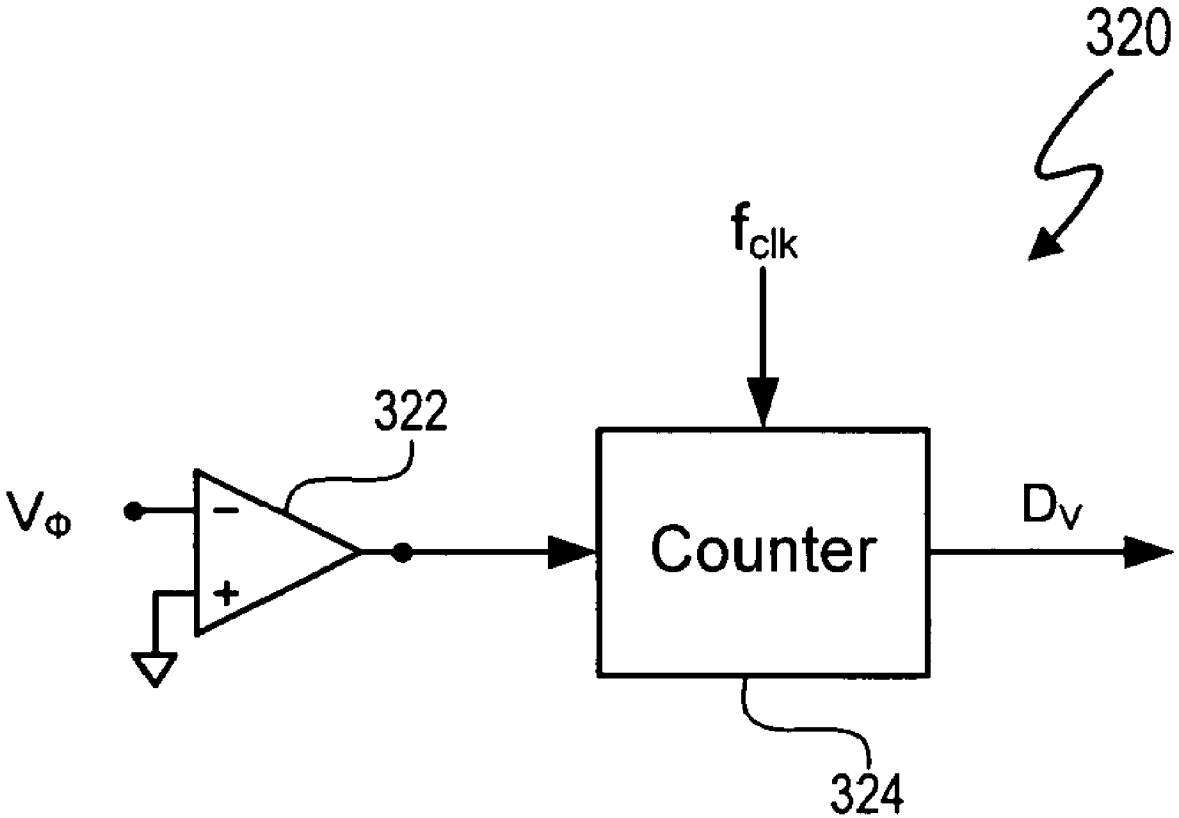
FIG. 3C depicts a phase delay detector.

FIG. 3C depicts a phase delay detector 320 to determine phase delays of leading and trailing edges of phase modulated output signal $V_\Phi$. Phase delay detector 320 represents one embodiment of phase delay detector 356. Comparator 322 compares phase modulated output signal $V_\Phi$ against a known reference. The reference is generally the cycle cross-over point voltage of phase modulated output signal $V_\Phi$, such as a neutral potential of a household AC voltage. The counter 324 counts the number of cycles of clock signal $f_{clk}$ that occur until the comparator 322 indicates that an edge of phase modulated output signal $V_\Phi$ has been reached. Since the frequency of phase modulated output signal $V_\Phi$ and the frequency of clock signal $f_{clk}$ are known, a leading edge phase delay can be determined from the count of cycles of clock signal $f_{clk}$ that occur from the beginning of a half cycle until the comparator 322 indicates the leading edge of phase modulated output signal $V_\Phi$. Likewise, the trailing edge of each half cycle can be determined from the count of cycles of clock signal $f_{clk}$ that occur from a trailing edge until an end of a half cycle of phase modulated output signal $V_\Phi$. The counter 324 converts the phase delays into digital dimmer output signal values $D_V$ for each cycle of phase modulated output signal $V_\Phi$.

Figure 3D:
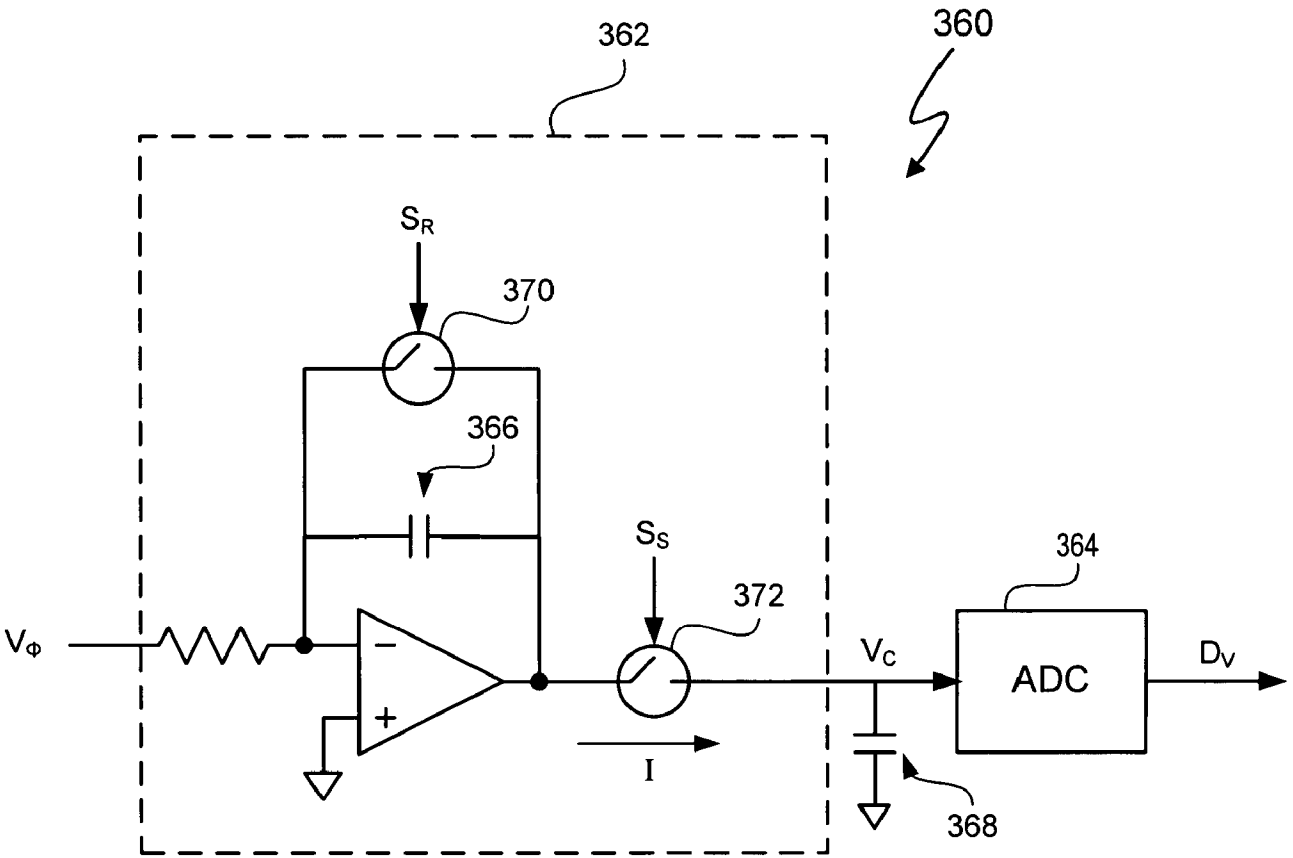
FIG. 3D depicts another phase delay detector.

FIG. 3D depicts a phase delay detector 360. Phase delay detector 360 represents one embodiment of phase delay detector 356 in FIG. 3B. The phase delay detector 360 includes an analog integrator 362 that integrates dimmer output signal $V_{DIM}$ during each cycle (full or half cycle) of phase modulated output signal $V_\Phi$. The analog integrator 362 generates a current I corresponding to the duty cycle of phase modulated output signal $V_\Phi$ for each cycle of phase modulated output signal $V_\Phi$. The current provided by the analog integrator 362 charges a capacitor 368 to threshold voltage $V_C$, and the voltage $V_C$ across capacitor 368 can be determined by analog-to-digital converter (ADC) 364. The analog integrator 362 can be reset after each cycle of phase modulated output signal $V_\Phi$ by discharging capacitors 366 and 368. Switch 370 includes a control terminal to receive reset signal $S_R$. Switch 372 includes a control terminal to receive sample signal $S_S$. The charge on capacitor 368 is sampled by capacitor 366 when control signal $S_S$ causes switch 372 to conduct. After sampling the charge on capacitor 368, reset signal $S_R$ opens switch 370 to discharge and, thus, reset capacitor 368. In at least one embodiment, switches 370 and 372 are n-channel field effect transistors, and sample signal $S_S$ and reset signal $S_R$ have non-overlapping pulses. In at least one embodiment, each cycle of dimmer output signal $V_{DIM}$ can be detected by every other zero crossing of dimmer output signal $V_{DIM}$.

Figure 5:
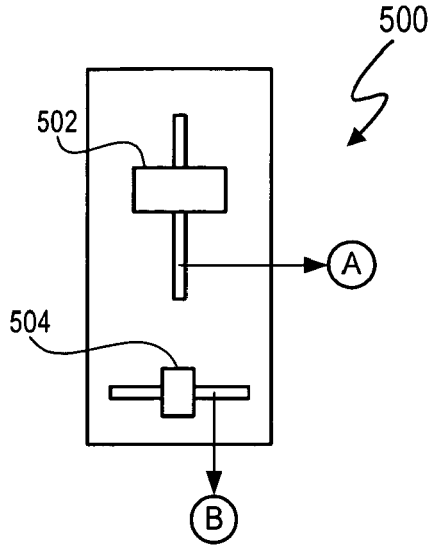
FIG. 5 depicts one embodiment of a dimmer for controlling two functions of a lighting circuit.
Figure 6:
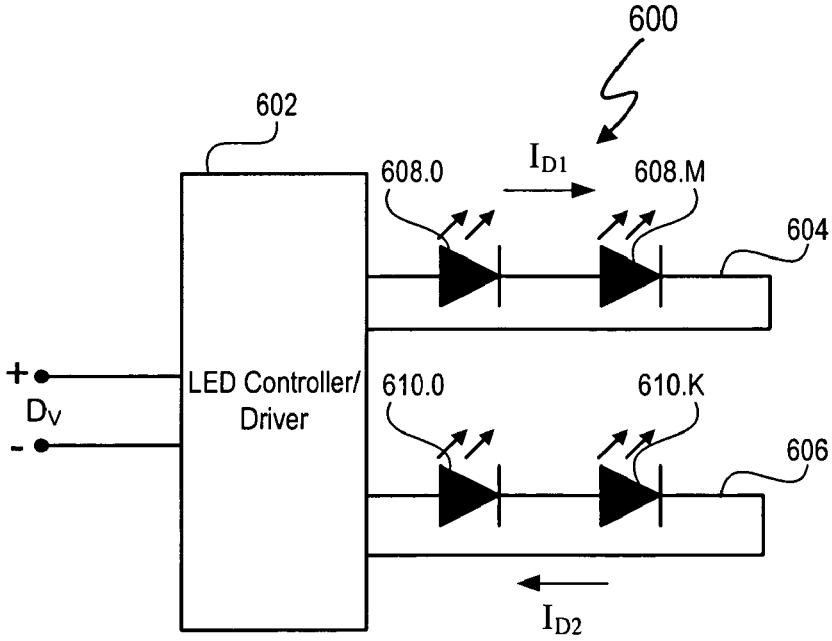
FIG. 6 depicts a lighting circuit.

The phase modulators 300 and 350 can be used in a variety of applications such as applications where the phase delays of a waveform provides a control input. FIG. 5 depicts one embodiment of a dimmer 500 for controlling two functions of a lighting circuit, such as lighting circuit 600 (FIG. 6). In one embodiment, dimmer 500 represents one embodiment of the phase modulator 300, in another embodiment, dimmer 500 represents one embodiment of the phase modulator 350. The dimmer includes two slideable switches 502 and 504. In at least one embodiment, moving switch 502 vertically provides an input A, which selects the value of selectable current $I_1$ by varying the resistance of variable resistor 304. In at least one embodiment, moving switch 504 horizontally provides an input B, which selects the value of selectable current $I_2$ by varying the resistance of variable resistor 306. Thus, in at least one embodiment, switches 502 and 504 control the phase delays of respective positive and second half cycles of phase modulated output signal $V_\Phi$ (FIG. 3).

FIG. 6 depicts an exemplary lighting circuit 600. The lighting circuit 600 represents one embodiment of a load for phase modulator 300. The lighting circuit 600 includes a LED Controller/Driver circuit 602 that responds to digital data $D_V$. The items of information derived from phase delays of phase modulated output signal $V_\Phi$ and represented by the digital data $D_V$ can be converted into respective control signals for controlling, for example, the drive currents to LED bank 604. LED bank 604 includes one or more LEDs 608.0 through 608.M, where M is a positive integer. LED bank 606 includes one or more LEDs 610.0 through 610.K, where K is a positive integer. The LED Controller/Driver circuit 602 provides drive currents $I_{D1}$ and $I_{D2}$ to respective LED banks 604 and 606 to control the intensity of each LED in LED banks 604 and 606. In at least one embodiment, the average values of the drive currents $I_{D1}$ and $I_{D2}$ directly correspond to the respective phase delays of the first and second half cycles of phase modulated output signal $V_\Phi$. Thus, the intensity of LED banks 604 and 606 can be varied independently. In at least one embodiment, the LED banks 604 and 606 contain different colored LEDs. Thus, varying the intensity of LED banks 604 and 606 also varies the blended colors produced by LED banks 604 and 606.

Exemplary embodiments of LED Controller/Driver circuit 602 are described in Melanson I, Melanson II, Melanson V, and Melanson VII.

Figure 7:
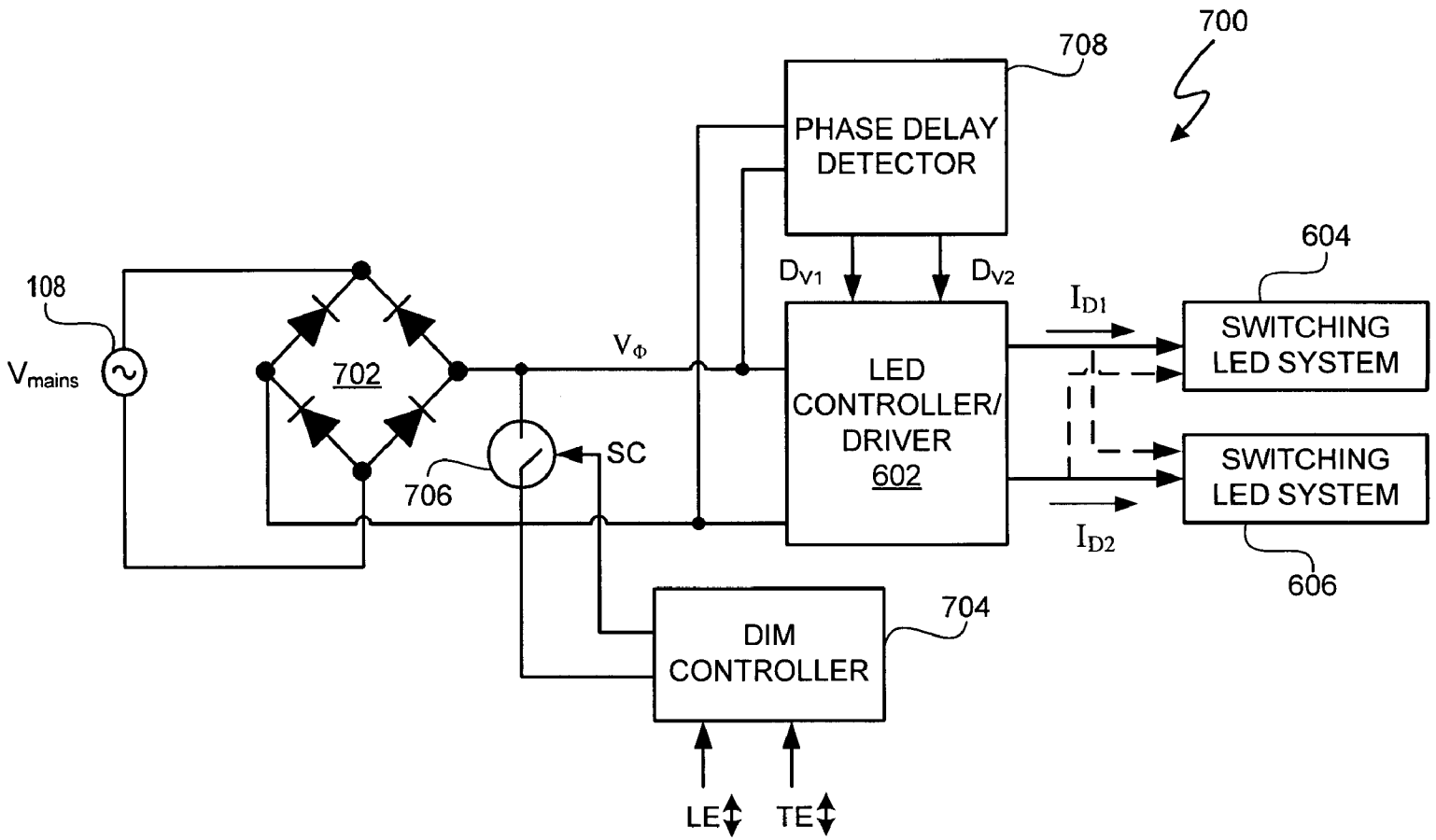
FIG. 7 depicts a light emitting diode (LED) lighting and power system.

FIG. 7 depicts a light emitting diode (LED) lighting and power system 700. The lighting and power system 700 utilizes phase delays of a phase modulated output signal $V_\Phi$ to generate independently determined LED drive currents. A full diode bridge 702 rectifies the AC mains voltage $V_{mains}$. The dim controller 704 receives leading edge LE and trailing edge TE phase delay inputs. In at least one embodiment, the leading edge LE and trailing edge TE inputs represent signals specifying the leading edge and trailing edge phase delays of each half cycle of phase modulated output signal $V_\Phi$ in accordance with waveform 400A. In other embodiments, dim controller 704 receives inputs to generate phase delays in accordance with waveforms 400B, 400C, 400D, or 400E. The dim controller 704 generates a chopping control signals SC. The chopping control signal SC causes switch 706 to switch ON and OFF, where "ON" is conductive and "OFF" is nonconductive. When switch 706 is ON, the phase modulated output signal $V_\Phi$ equals zero, and when switch 706 is OFF, phase modulated output signal $V_\Phi$ equals $V_{mains}$. Thus, dim controller 704 generates a leading edge phase delay when switch 706 transitions from ON to OFF and generates a trailing edge phase delay when switch 706 transitions from OFF to ON.

The phase delay detector 708 detects the phase delays of phase modulated output signal $V_\Phi$ and generates respective digital data dimmer signals $D_{V1}$ and $D_{V2}$. In at least one embodiment, the phase delay detector 708 can be any phase delay detector, such as phase delay detector 320 or phase delay detector 360. The digital data dimmer signals $D_{V1}$ and $D_{V2}$ represent respective items of information derived from the phase delays of each cycle of phase modulated output signal $V_\Phi$ as, for example, set forth in Table 2. In at least one embodiment, the digital data dimmer signals $D_{V1}$ and $D_{V2}$ are mapped to respective dimming levels in accordance with Melanson III.

The LED controller/driver 602 converts the digital data dimmer signals $D_{V1}$ and $D_{V2}$ into respective control signals $I_{D1}$ and $I_{D2}$. In at least one embodiment, control signals $I_{D1}$ and $I_{D2}$ are LED drive currents $I_{D1}$ and $I_{D2}$. In at least one embodiment, LED controller/driver 602 generates LED drive currents $I_{D1}$ and $I_{D2}$ in accordance with Melanson IV. In at least one embodiment, LED controller/driver 602 includes a switching power converter that performs power factor correction on the phase modulated output signal V and boosts the phase modulated output signal $V_\Phi$ to an approximately constant output voltage as, for example, described in Melanson V and Melanson VI. The LED drive currents $I_{D1}$ and $I_{D2}$ provide current to respective switching LED systems 604 and 606. The switching LED systems 604 and 606 each include one or more LEDs. In at least one embodiment, the control signals $I_{D1}$ and $I_{D2}$ cause each switching LED systems 604 and 606 to operate independently. In at least one embodiment, the control signals $I_{D1}$ and $I_{D2}$ are both connected to each of switching LED systems 604 and 606 (as indicated by the dashed lines) and cause each switching LED systems 604 and 606 to operate in unison with two different functions. For example, control signal $I_{D1}$ can adjust the brightness of both switching LED systems 604 and 606, and control signal $I_{D2}$ can adjust a color temperature of both switching LED systems 604 and 606

Thus, in at least one embodiment, the phase modulator 300 generates a phase modulated output signal with 2 to 4 independent phase delays for each cycle of the phase modulated output signal. Each independent phase delay per cycle represents an independent item of information. In at least one embodiment, detected, independent phase delays can be converted into independent control signals. The control signals can be used to control drive currents to respective circuits, such as respective sets of light emitting diodes.

Although the present invention has been described in detail, it should be understood that various changes, substitutions and alterations can be made hereto without departing from the spirit and scope of the invention as defined by the appended claims.

What is claimed is:

1. An apparatus comprising:

a dimming control to receive at least two respective inputs representing respective dimming levels;

a dimming signal generator, coupled to the dimming control, to generate a phase modulated output signal having at least two independently generated phase delays per cycle of the phase modulated mains voltage signal, wherein each dimming level is represented by one of the phase delays.

2. The apparatus of claim 1 wherein a first phase delay per cycle represents a first light emitting diode (LED) dimming level and a second phase delay per cycle represents a second LED dimming level.

3. The apparatus of claim 1 wherein a waveform of a cycle of the phase modulated output signal includes leading and trailing edge phase delays for both a first half cycle and a second half cycle of the waveform, and the first half cycle waveform and the second half cycle waveform have approximately equal areas.

4. A method comprising:

receiving at least two respective inputs representing respective dimming levels;

independently generating at least two phase delays per cycle in a mains voltage signal to generate a phase modulated output signal, wherein each phase delay per cycle represents a respective dimming level.

5. The method of claim 4 wherein a first phase delay per cycle represents a first light emitting diode (LED) dimming level and a second phase delay per cycle represents a second LED dimming level.

6. The method of claim 4 wherein a waveform of a cycle of the phase modulated output signal includes leading and trailing edge phase delays for both a first half cycle and a second half cycle of the waveform, and the first half cycle waveform and the second half cycle waveform have approximately equal areas.

* * * * *